US010697727B2

(12) United States Patent
Higgins

(10) Patent No.: US 10,697,727 B2
(45) Date of Patent: Jun. 30, 2020

(54) UNIVERSAL HOLSTER ASSEMBLY

(71) Applicant: Stephen Mark Higgins, Carrollton, TX (US)

(72) Inventor: Stephen Mark Higgins, Carrollton, TX (US)

( * ) Notice: Subject to any disclaimer, the term of this patent is extended or adjusted under 35 U.S.C. 154(b) by 431 days.

(21) Appl. No.: 14/957,224

(22) Filed: Dec. 2, 2015

(65) Prior Publication Data

US 2016/0153745 A1 Jun. 2, 2016

Related U.S. Application Data

(60) Provisional application No. 62/086,554, filed on Dec. 2, 2014.

(51) Int. Cl.

| | |
|---|---|
| ***F41C 33/02*** | (2006.01) |
| ***F41A 23/18*** | (2006.01) |
| ***F41C 33/06*** | (2006.01) |

(52) U.S. Cl.

CPC ..... *F41A 23/18* (2013.01); *F41C 33/0209* (2013.01); *F41C 33/06* (2013.01)

(58) Field of Classification Search

CPC ..... F41A 23/18; F41C 33/0209; F41C 33/06; A47B 81/005; A47B 43/003; A47B 45/00

USPC ..... 206/317

See application file for complete search history.

(56) References Cited

U.S. PATENT DOCUMENTS

| | | | | |
|---|---|---|---|---|
| 2,285,035 A * | 6/1942 | Kenney | F41A 23/18 | 211/64 |
| 3,329,278 A * | 7/1967 | Pachmayr | F41A 23/18 | 206/317 |
| 4,537,315 A * | 8/1985 | Griffin | A47G 21/14 | 206/553 |
| 4,971,208 A * | 11/1990 | Reinfried, Jr. | A47B 81/005 | 211/64 |
| 5,228,578 A * | 7/1993 | Wu | A47B 65/20 | 211/175 |
| 5,350,070 A * | 9/1994 | Stamatopoulos | A47B 81/005 | 211/4 |
| 5,415,297 A * | 5/1995 | Klein | A47B 81/068 | 108/61 |
| 6,321,918 B1 * | 11/2001 | Rollins | A47B 87/0207 | 211/194 |
| 7,159,711 B1 * | 1/2007 | Gardner | F41C 33/06 | 206/315.11 |

(Continued)

*Primary Examiner* — King M Chu

(74) *Attorney, Agent, or Firm* — Jack D. Stone, Jr.; Scheef & Stone, L.L.P.

(57) ABSTRACT

The present invention provides for a universal holster assembly for securely storing one or more handguns. The holster assembly comprises a first and second end walls. A supporting pad is located between the first and second end walls. The first and second end walls and the supporting pad define a cradle configured for holstering a handgun. A hollow tube extends through a set of aligned openings formed in the first and second end walls and the supporting pad. A plug having a head and a body is used to secure each end of the tube. The body is inserted into an end of the tube and a head urging against an exterior surface of one of the end walls, thus securing the holster assembly. Additional cradles may be defined by adding dividing walls and additional supporting pads. Further, one or more storage compartments may also be provided.

21 Claims, 18 Drawing Sheets

(56) References Cited

U.S. PATENT DOCUMENTS

| | | | | |
|---|---|---|---|---|
| 7,584,861 | B2 * | 9/2009 | Werner | A47B 45/00 211/184 |
| 7,934,610 | B2 * | 5/2011 | Zeng | A47G 21/14 211/70.7 |
| 8,376,152 | B2 * | 2/2013 | Holmes, Jr. | E05G 1/06 211/64 |
| 2002/0162815 | A1 * | 11/2002 | Wang | A47B 43/003 211/194 |
| 2005/0230334 | A1 * | 10/2005 | MacDonald | A47B 43/00 211/64 |
| 2015/0182020 | A1 * | 7/2015 | Rahman | B60R 7/14 211/64 |
| 2015/0300777 | A1 * | 10/2015 | Stalker | F41C 33/0236 248/676 |

* cited by examiner

UNIVERSAL HOLSTER ASSEMBLY

CROSS-REFERENCE TO RELATED APPLICATION

This application claims the benefit of U.S. Provisional Application No. 62/086,554, filed Dec. 2, 2014, which application is hereby incorporated herein by reference, in its entirety.

TECHNICAL FIELD

The present invention relates to a holster assembly for securely holding one or more handguns.

BACKGROUND

Ownership of firearms and personal defense weapons is on the rise. Many individuals own several handguns. The term handguns as used herein includes handguns, revolvers, Tasers, pistols, stun guns, and the like effective for protection. When not in use, handguns are often stored in a gun safe or locker. Handguns are often laid on their side, which takes up valuable shelf space in the gun safe, and renders handguns vulnerable to being scratched and damaged. This can also be unsafe as handguns can get mixed in with other firearms and items stored in the safe.

Accordingly, what is needed is a holster assembly for storing a handgun that more efficiently uses the available space in a gun safe and that protects the handgun from damage. It would also be desirable for such a holster assembly to be durable, yet capable of being manufactured cost effectively.

SUMMARY OF THE INVENTION

The present invention provides for a holster assembly for securely storing one or more handguns. The holster comprises first and second end walls. A supporting pad is secured between the first and second end walls. The first and second end walls and the supporting pad define a cradle configured for holstering a handgun. A hollow tube extends through an array of aligned openings formed in the first and second end walls and the supporting pad. A plug having a body that is inserted into an end of the tube and a head that urges against an exterior surface of one of the end walls secures the holster assembly.

In other embodiments, additional cradles may be formed by adding dividing walls and additional supporting pads. In yet other embodiments, one or more storage compartments are provided.

A method for assembling a holster assembly for holstering one or more handguns is also provided. A first end wall and a second end wall are cut from a sheet of plastic. A supporting pad configured to holster a handgun is cut from a sheet of foam. An array of aligned openings are formed in the supporting pad, the first end wall, and the second end walls. A hollow tube is extended through the array of aligned openings. The first end wall, the second end wall, and the supporting pad are urged into position along the tube, the supporting pad being secured between the first end wall and the second end wall. An end of the tube is then cut to a length equal to the approximate length of the set of aligned openings. A body of a plug is inserted into an end of the tube, thereby urging a head of the plug against an exterior surface of one of either the first end wall or the second end wall.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
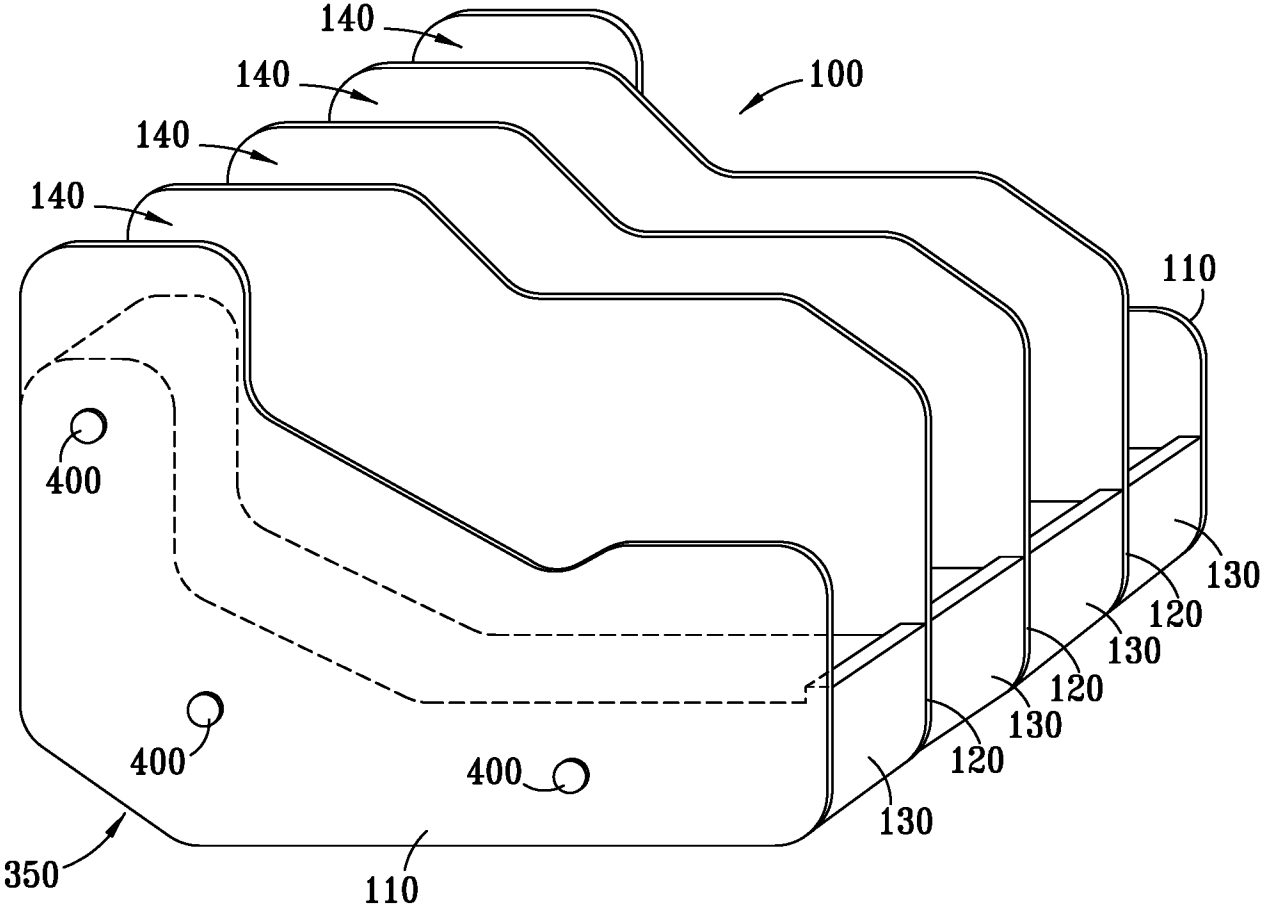
FIG. 1 is an isometric view of a holster assembly exemplified in accordance with a first embodiment of the present invention.

In the discussion of the FIGURES, the same reference numerals will be used throughout to refer to the same or similar components. In the interest of conciseness, various other components known to the art, such as pistols and the like, have not been shown or discussed in detail. Additionally, as used herein, the term "substantially" is to be construed as a term of approximation. The term handguns as used herein includes handguns, revolvers, Tasers, pistols, stun guns, and the like effective for protection.

Referring to FIG. 1 of the drawings, the reference numeral 100 generally designates a universal holster assembly embodying features of the present invention. Holster assembly 100 comprises a pair of end walls 110 and dividing walls 120. Dividing walls 120 are secured between end walls 110. Supporting pads 130 are located between end walls 110 and dividing walls 120, and each supporting pad 130 along with the adjacent walls define a cradle 140 configured for holstering a handgun. Fasteners 400, discussed in further detail with respect to FIG. 4, secure end walls 110, dividing walls 120, and supporting pads 130.

As exemplified in FIG. 1, holster assembly 100 provides four cradles 140 for holstering four handguns. In alternate embodiments, fewer or additional cradles may be provided by adding or subtracting dividing walls and supporting pads as is evident to one of ordinary skill in the art.

Optionally, angled seat 350 is formed in end walls 110, dividing walls 120, and supporting pads 130. Angled seat 350 is configured to allow holster assembly 100 to balance at an angled position and also reduces material used in the fabrication of holster assembly 100.

Figure 2:
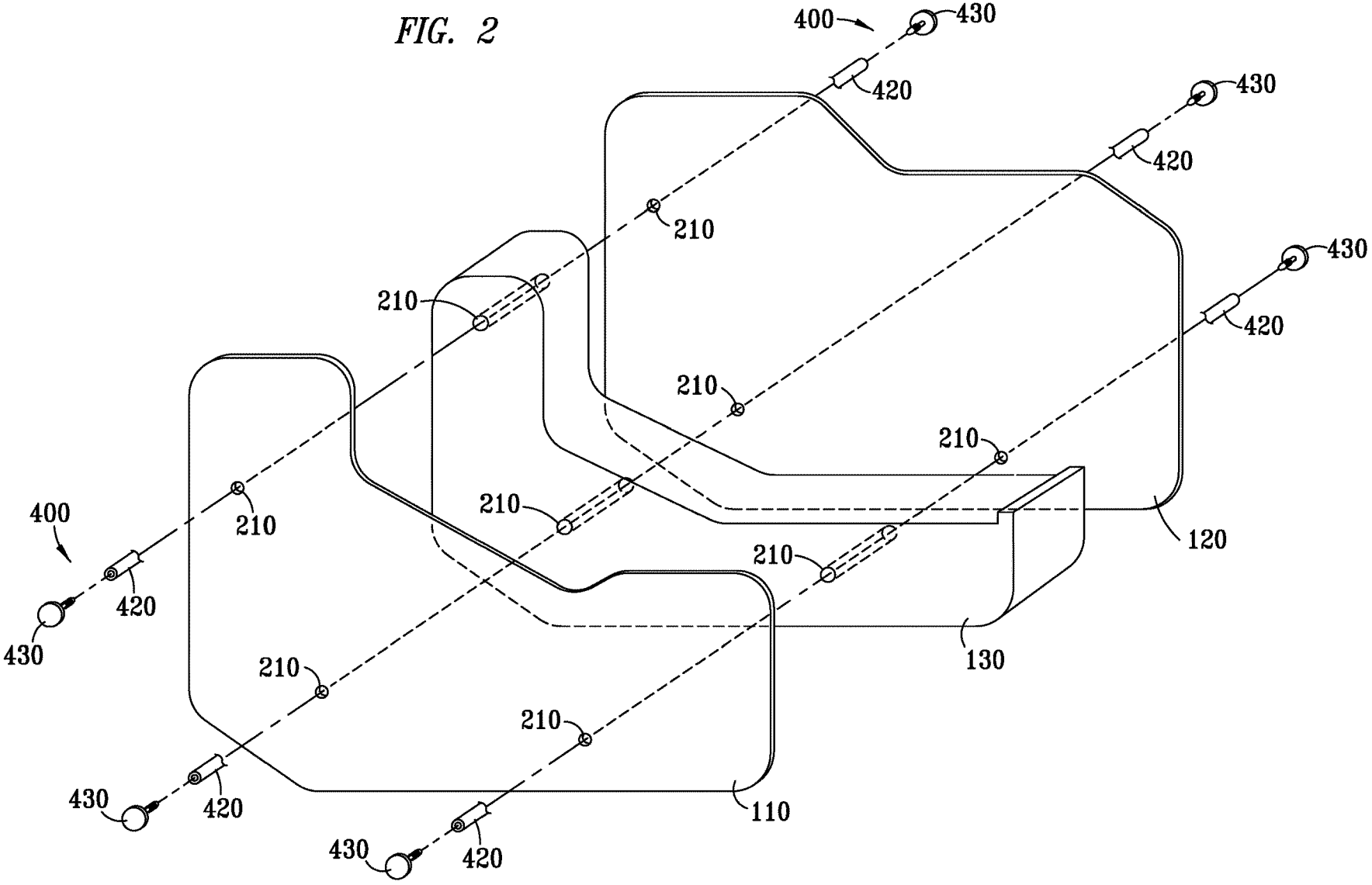
FIG. 2 is a partially-exploded view of the holster assembly of FIG. 1.

Referring to FIG. 2, a partially-exploded view of holster assembly 100 is provided. Preferably, three arrays of aligned openings 210 are formed in each end wall 110, dividing wall 120, and supporting pad 130. Fasteners 400 comprising tubes 420 and plugs 430 are used to secure holster assembly 100. Tubes 420 extend through each array of aligned openings 210. Plugs 430 are inserted into the ends of tubes 420. In alternate embodiments, additional arrays of aligned openings are formed and secured by additional tubes, or fewer arrays of aligned openings are formed and secured by fewer tubes.

Figure 3:
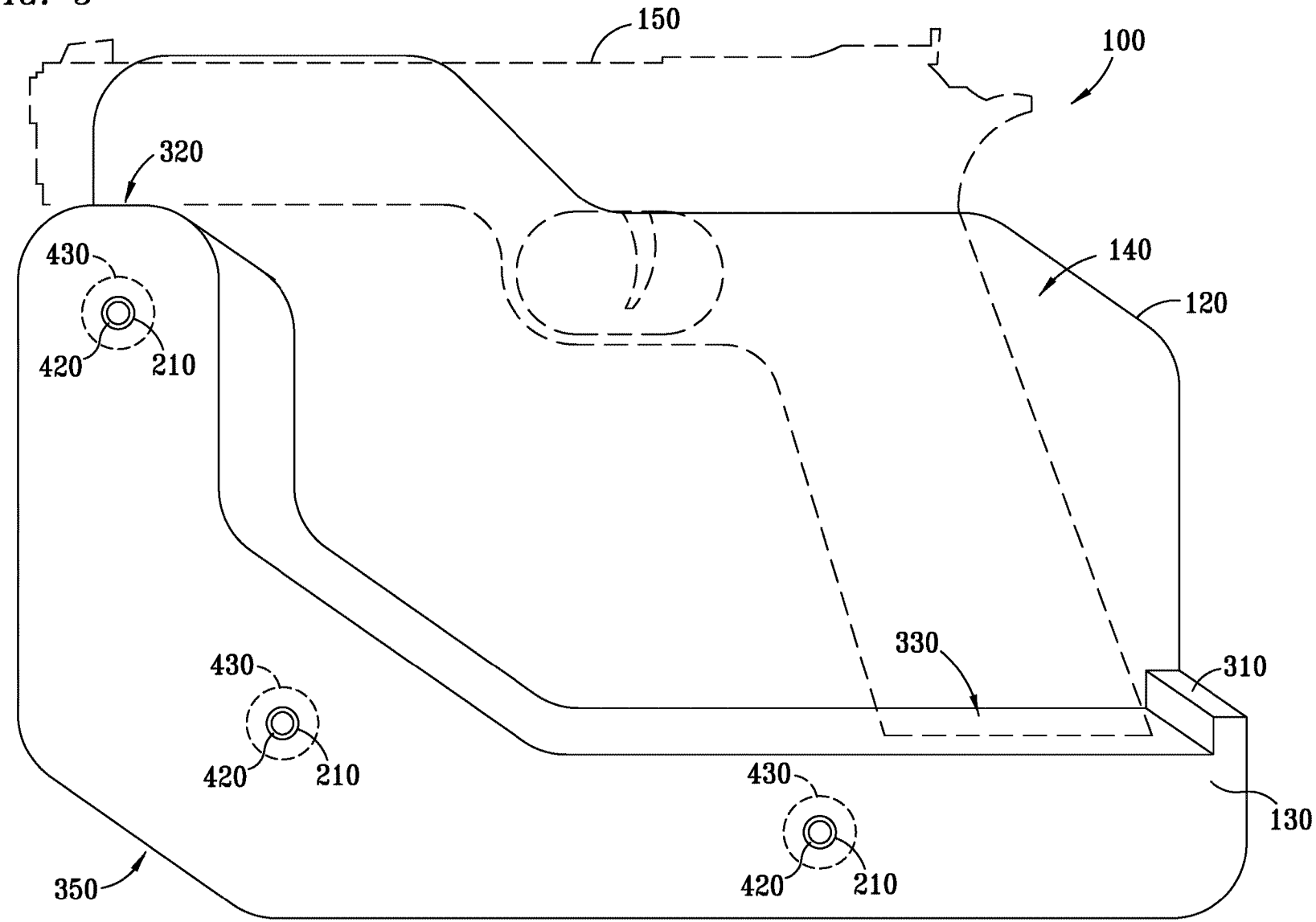
FIG. 3 is a perspective, side view of the holster assembly of FIG. 1 taken having an end wall removed and exemplified holstering a handgun.

Referring to FIG. 3, holster assembly 100 is exemplified holstering handgun 150. Supporting pad 130 is preferably generally L-shaped. Flange 310 is formed at one end of supporting pad 130. When handgun 150 is placed in cradle 140, flange 310 secures the heel of handgun 150. Grip-support surface 330 of supporting pad 130 is provided adjacent to flange 310 and supports the bottom surface of the grip of handgun 150. Barrel-support surface 320 is provided at the opposite end of supporting pad 130 as flange 310. Barrel-support surface 320 supports the barrel of handgun 150 when it is holstered in cradle 140. Dividing wall 120 and end wall 110 (FIG. 1) laterally secure handgun 150 in cradle 140. Dividing walls 120 are configured to be to prevent handguns in adjacent cradles 140 from coming in contact with one another, thus preventing scratching and damage. End walls 110 (see FIG. 1) are preferably shorter than dividing walls 120 as there is no handgun on the exterior side. This has the benefit of saving material and thus reducing costs. In alternative embodiments, end walls 110 can be the same shape and size as dividing walls 120.

Figure 4:
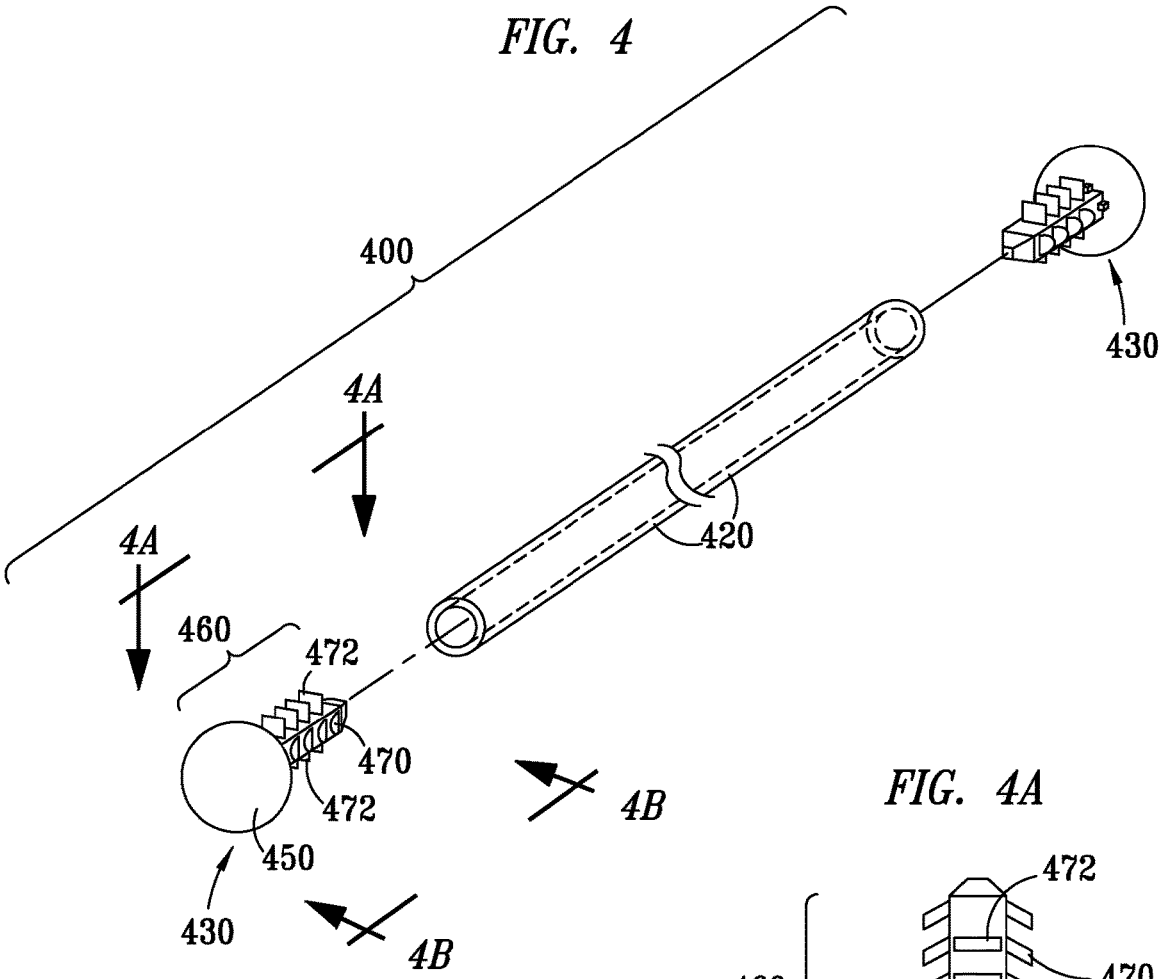
FIG. 4 is an isometric view of a tube-and-plug fastener exemplified in accordance with principles of the present invention.
Figure 4A:
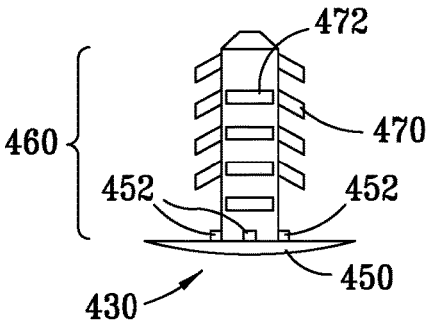
FIG. 4A is a side view of a plug utilized in the fastener of FIG. 4, taken along the line 4A-4A of FIG. 4.
Figure 4B:
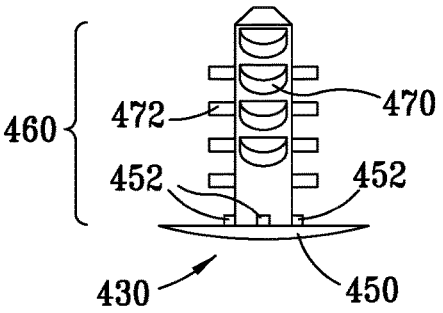
FIG. 4B is a side view of the plug of FIG. 4A, taken along view line 4B-4B of FIG. 4.

Referring to FIGS. 4, 4A, and 4B, tube-and-plug fastener 400 comprises tube 420 and plugs 430. In a preferred embodiment, tube 420 is fabricated from plastic, such as polyethylene, with an outside diameter of approximately 0.25 inches (0.6 cm). The length of tube 420 is determined by the width of the components being secured as discussed below. Plugs 430 are used to secure the ends of tube 420. Each plug 430 comprises head 450 and preferably rectangular body 460. Strengthening pillars 452 are provided where head 450 couples to body 460. Strengthening pillars 452 are advantageous as they strengthen the structural integrity of plug 430, while conserving material required to fabricate plug 430 and provide for a tighter fit between plug 430 and an end wall 110 being secured. Angled ribbing 470 and straight ribbing 472 are formed along the exterior surface of body 460. Ribbing 470 and 472 is configured for increasing friction between body 460 and tube 420 when body 460 is inserted into the end of tube 420. Each head 450 is configured to urge against the exterior surface of end walls 110 when securing the holster assembly (FIG. 1). Plugs 430 are preferably injection molded from plastic, such as polypropylene.

Figure 4C:
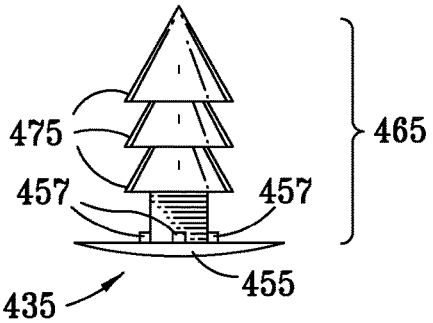
FIG. 4C is a side view of an exemplary plug utilized in the fastener of FIG. 4 in accordance with an alternate embodiment of the present invention.

Referring to FIG. 4C, plug 435 is provided in accordance with an alternate embodiment of the present invention. Plug 435, like plug 430, may be used to secure the ends of tube 420 (see FIG. 4). Each plug 435 comprises head 455 and body 465. Strengthening pillars 457 are provided where head 455 couples to body 465. Strengthening pillars 457 are advantageous as they strengthen the structural integrity of plug 435, while conserving material required to fabricate plug 435 and provide for a tighter fit between plug 435 and an end wall being secured. Conical ribbing 475 is formed along the exterior surface of body 465 for increasing resistance to removal of the body 465 from tube 420 when body 465 is inserted into the end of tube 420. Each head 455 is configured to urge against the exterior surface of end walls 110 when securing the holster assembly (FIG. 1). Plugs 435 are preferably injection molded from plastic, such as polypropylene.

Figure 5:
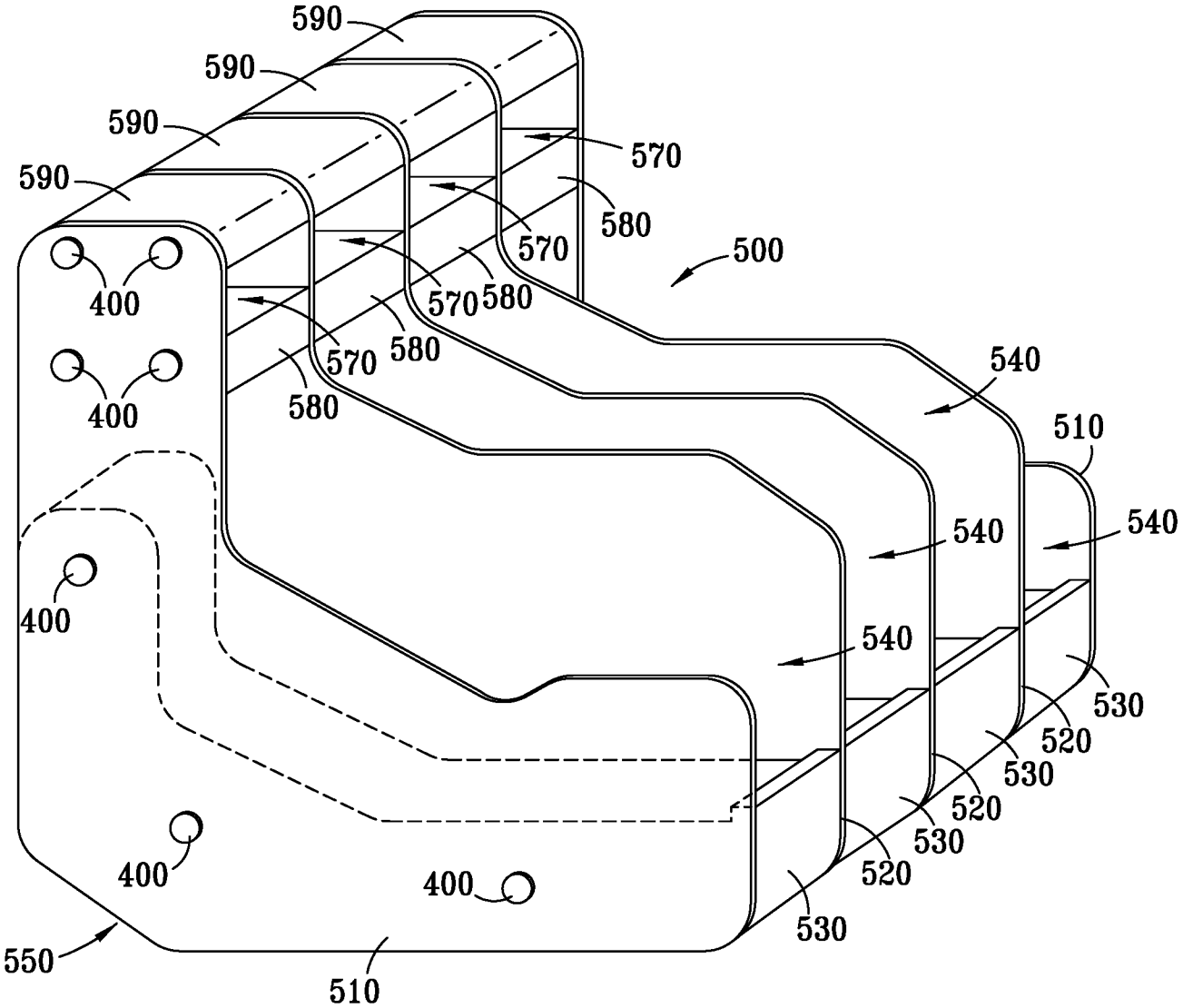
FIG. 5 is an isometric view of a holster assembly exemplified in accordance with a second embodiment of the present invention.
Figure 6:
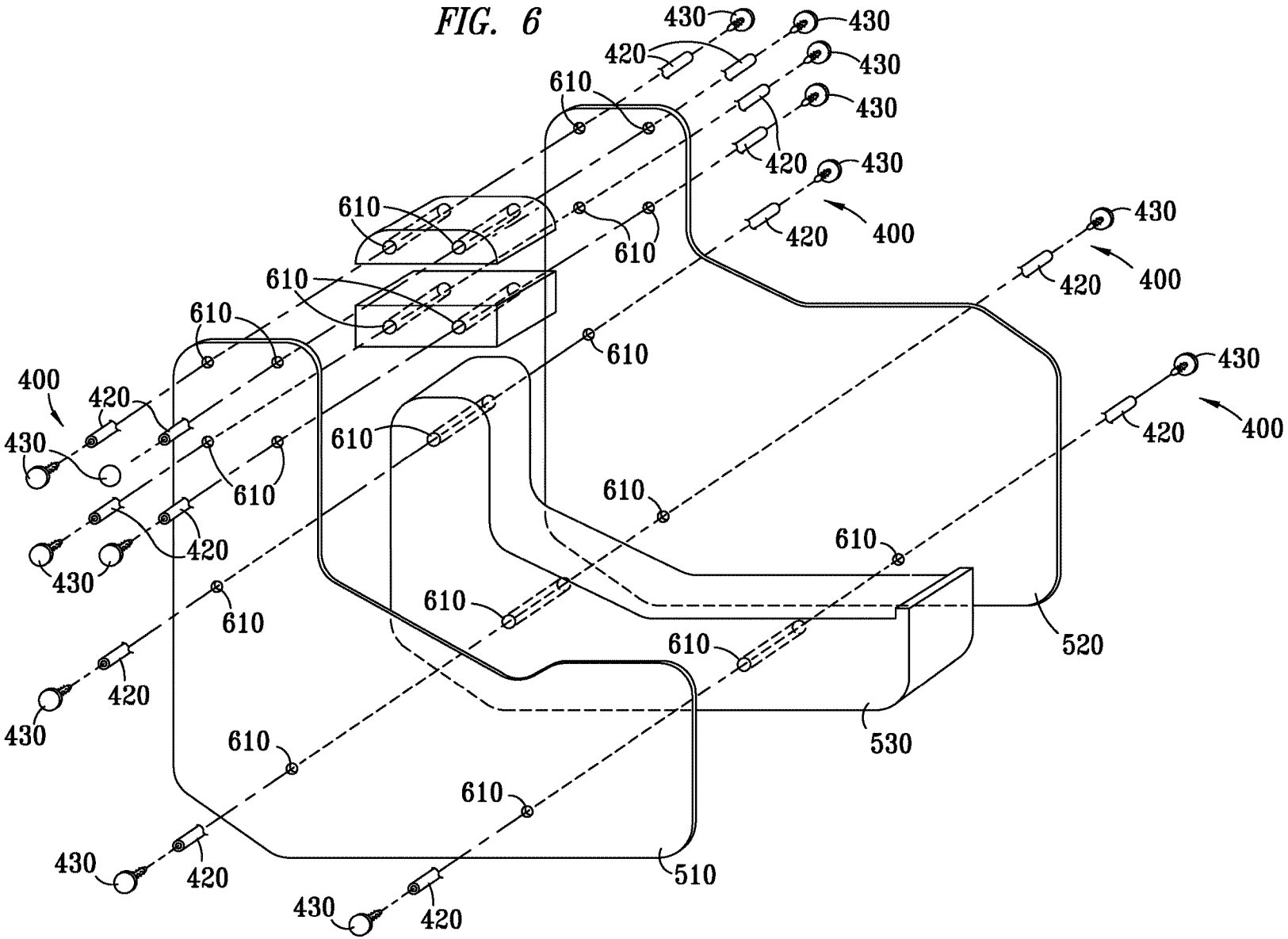
FIG. 6 is an exploded view of a portion of the holster assembly of FIG. 5.
Figure 7:
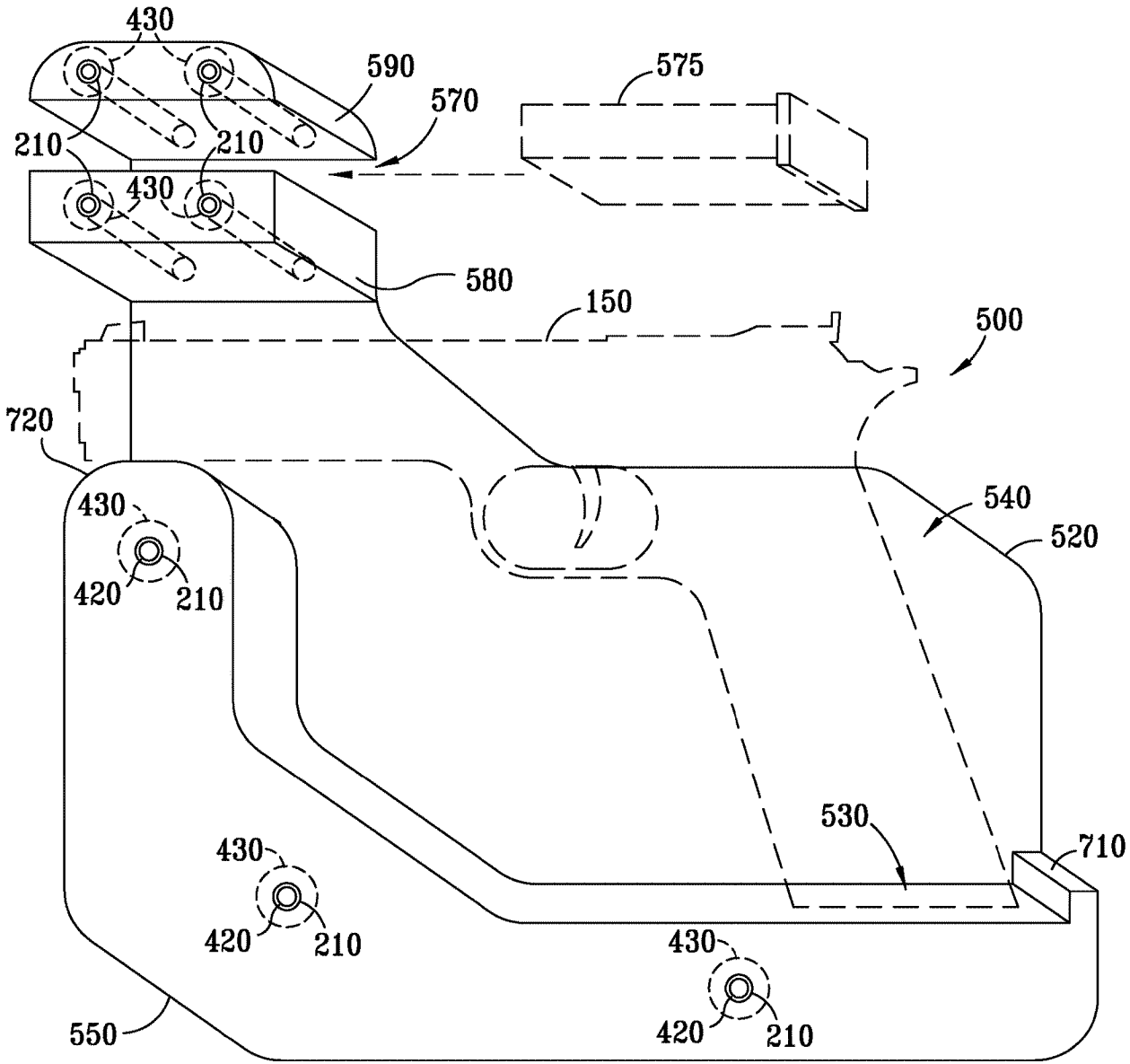
FIG. 7 is a perspective, side view of the holster assembly of FIG. 5, having an end wall removed and exemplified holstering a handgun and storing a magazine of ammunition.
Figure 8:
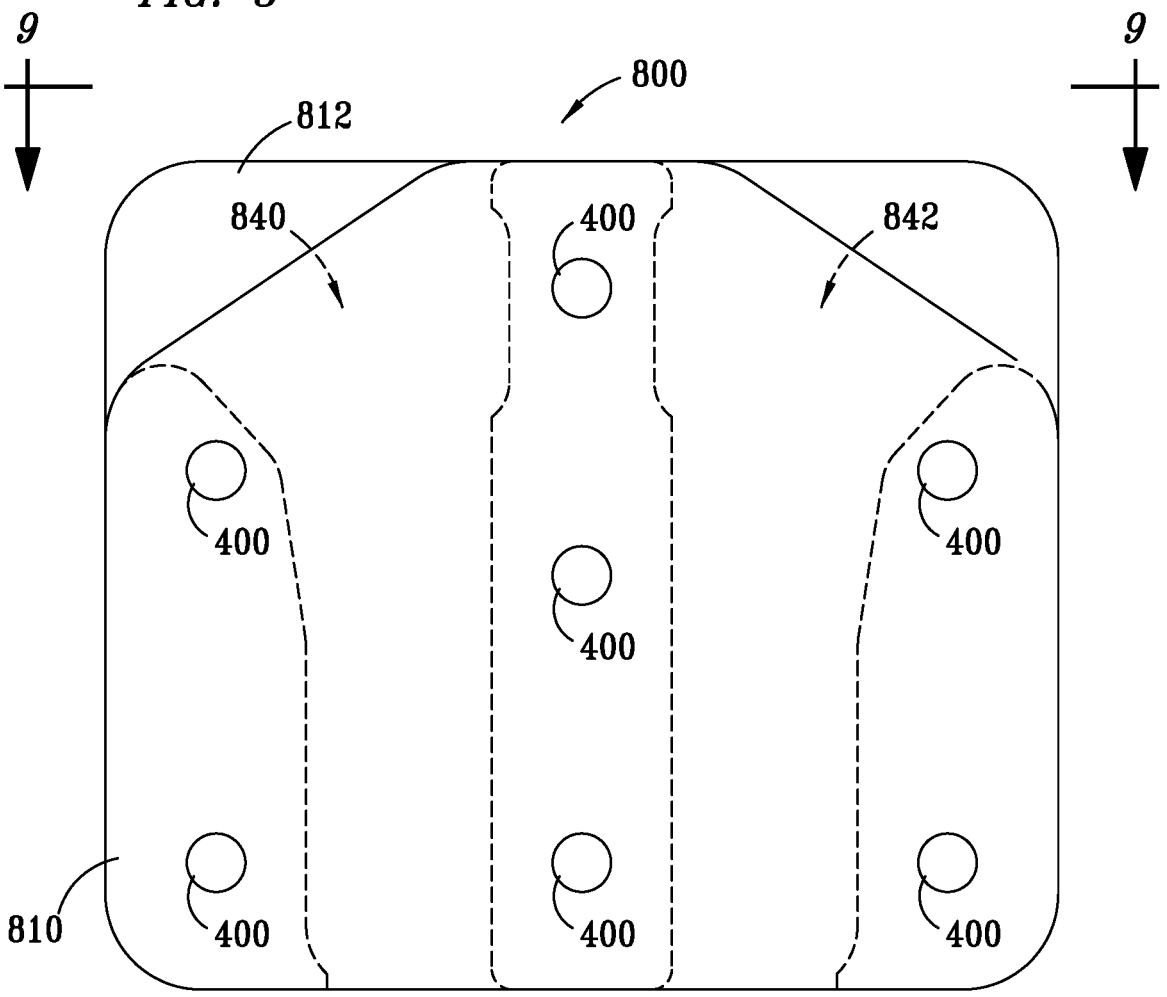
FIG. 8 is a front view of holster assembly exemplified in accordance with a third embodiment of the present invention.
Figure 9:
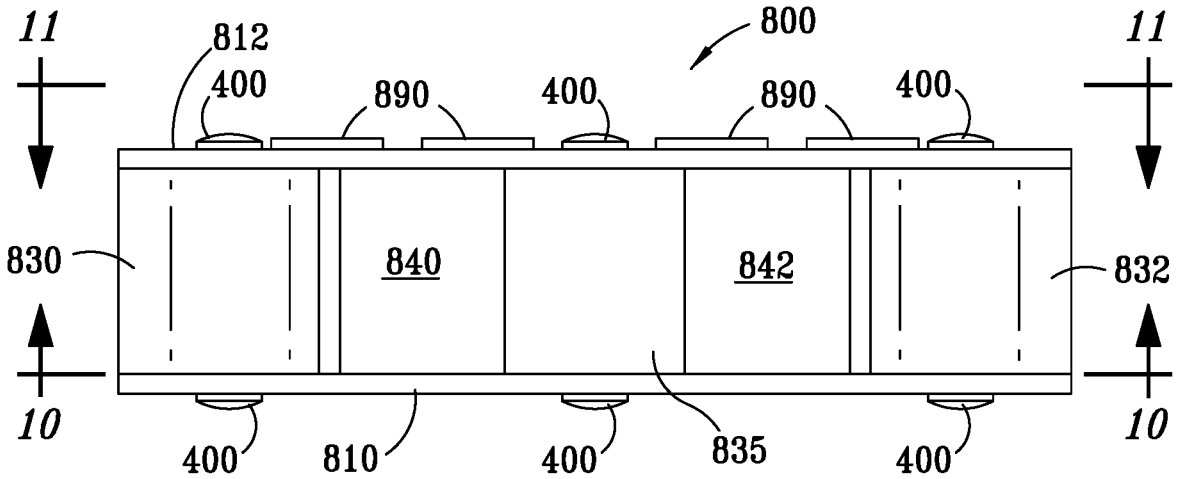
FIG. 9 is a top view of the holster assembly of FIG. 8 taken along view line 9-9 of FIG. 8.

Referring now to FIGS. 5-7, an alternative embodiment of the holster assembly, designated by reference numeral 500, is disclosed which provides for storage compartments. Accordingly, holster assembly 500 comprises end walls 510. Dividing walls 520 are secured between the end walls. To facilitate understanding, FIG. 6 depicts an exploded view of the embodiment of FIG. 5 between one end wall 510 and one dividing wall 520. Supporting pads 530 are located between end walls 510 and dividing walls 520. Flange 710, barrel-support surface 720, and grip-support surface 730 are provided (FIG. 7). FIG. 5 exemplifies four cradles 540 defined between the walls 510 and 520 and the supporting pads 530, though more or fewer cradles may be so defined. Handgun 150 is exemplified being holstered in cradle 540 (FIG. 7). Storage compartments 570 are formed above the cradles 540. Each storage compartment 570 is defined by a first auxiliary pad 580, a second auxiliary pad 590, and adjacent walls 510 and/or 520. Storage compartments 570 can be used to store any item, but is particularly useful for storing a magazine of ammunition 710 (FIG. 7). In other embodiments, storage compartments 570 are configured to store a flashlight. Angled seat 550 is formed in end walls 510, dividing walls 520, and supporting pads 530. Angled seat 550 is configured to allow holster assembly 500 to balance at an angled position and also reduces material used in the fabrication of holster assembly 500. Holster assembly 500 is secured using fasteners 400 (FIG. 4). Arrays of aligned openings 610 are formed in end walls 510, dividing walls 520, supporting pads 530, lower pads 580, and upper pads 590 (FIGS. 6-7). Tubes 420 extend through each array of aligned openings 610. The ends of tubes 420 are secured by plugs 430.

Referring to FIGS. 8-11, an alternative embodiment of the holster assembly, designated by reference numeral 800, comprises front end wall 810 and rear end wall 812. First cradle 840 for holstering a handgun is defined by front end wall 810, rear end wall 812, outer supporting pad 830, and inner supporting pad 835. Second cradle 842 for holstering a handgun is similarly defined by front end wall 810, rear end wall 812, outer supporting pad 832, and inner supporting pad 835. Holster assembly 800 is secured using fasteners 400 (FIG. 4), comprising tubes 420 and plugs 430. Tubes 420 are inserted into each array of aligned openings 910. The ends of each tube are secured by plugs 430.

Figure 10:
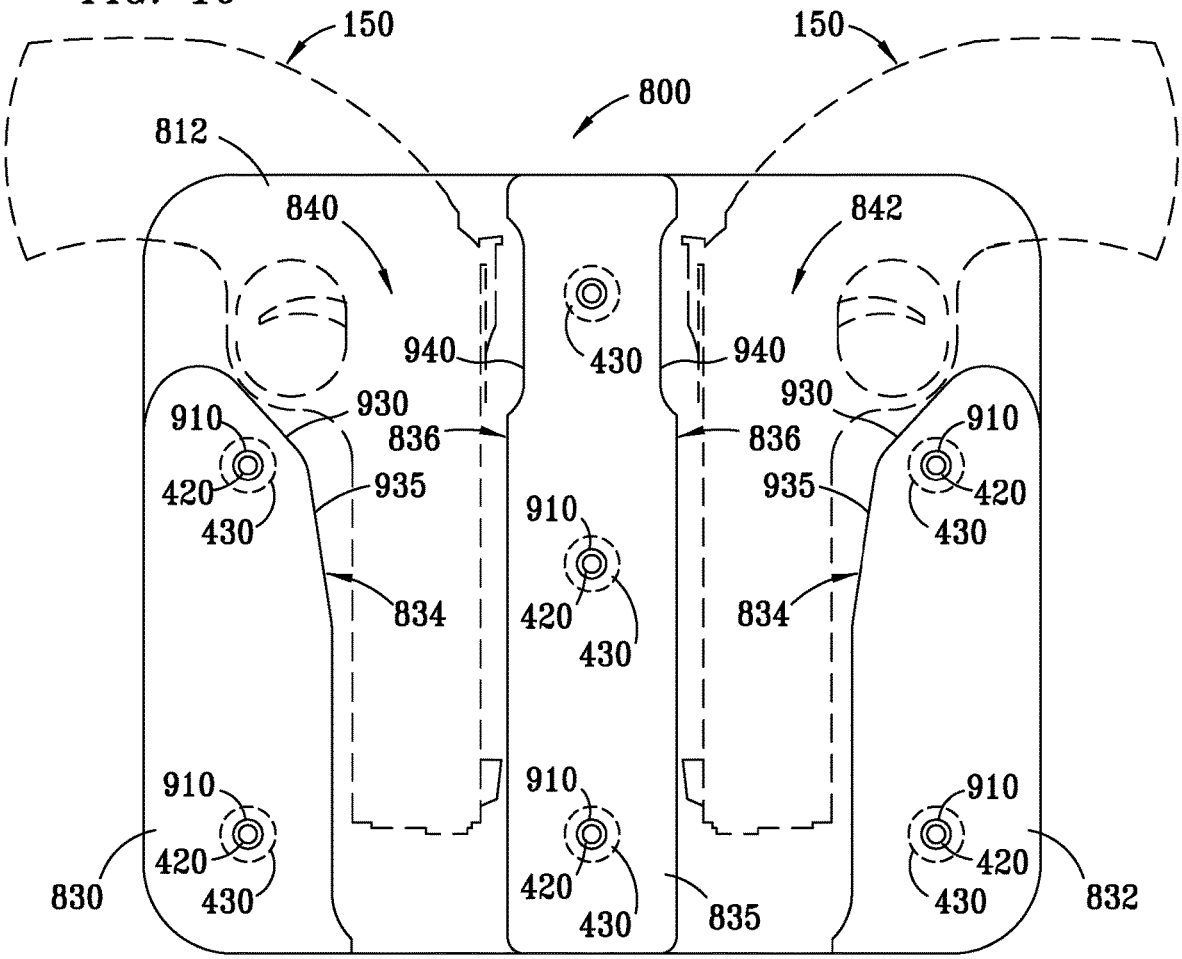
FIG. 10 is a cross-sectional view of the holster assembly of FIG. 8 taken along section line 10-10 of FIG. 9 exemplified holstering a pair of handguns.

Referring more specifically to FIG. 10, a first and a second trigger-guard rest slopes 930 and 935 are formed along cradle-facing surface 834 of each outer supporting pad 830 and 832. First trigger-guard slope 930 is configured to accommodate larger handguns while second trigger-guard slope 935 is configured to accommodate smaller handguns. Sight-slots 940 are formed along each barrel-support surface 836 of inner supporting pad 835 and are configured to prevent the sights of handguns 150 from damaging inner supporting pad 835.

Figure 11:
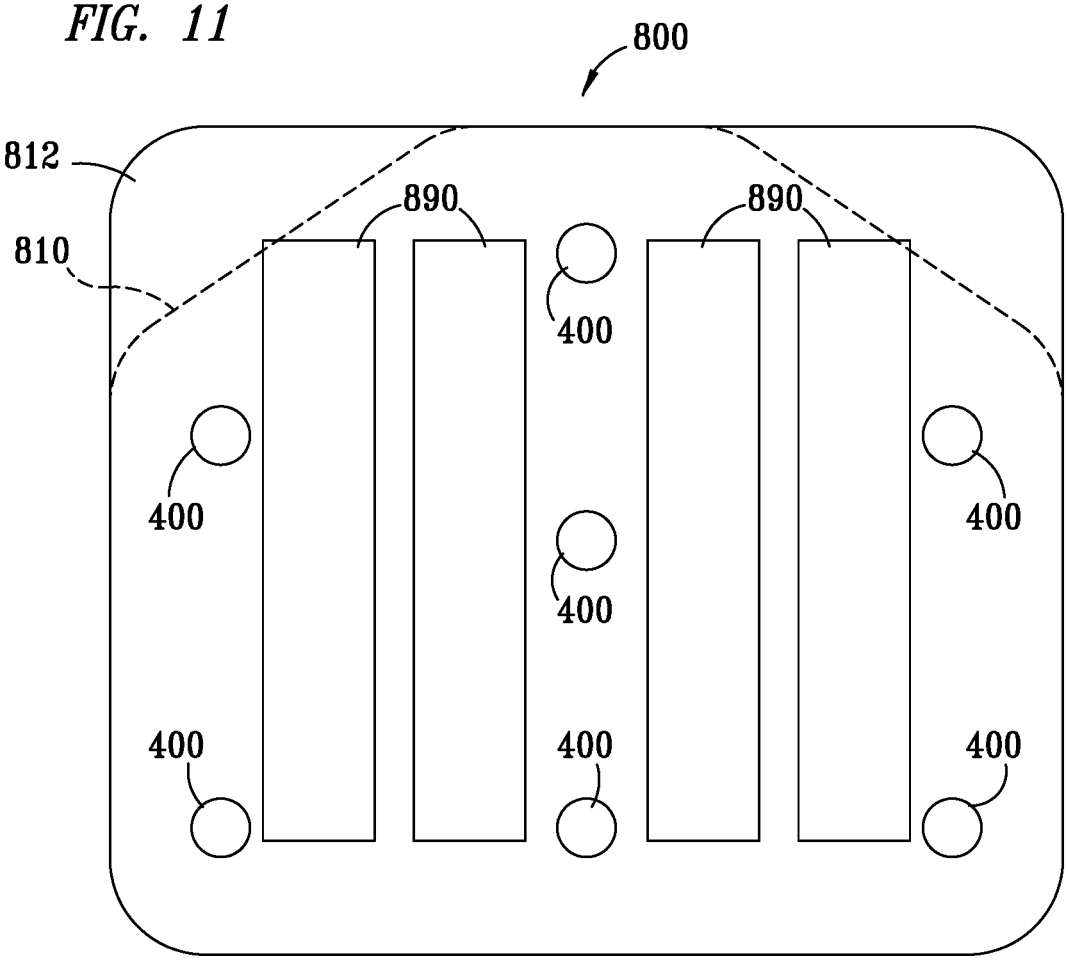
FIG. 11 is a rear view of the holster assembly of FIG. 8 taken along view line 11-11 of FIG. 9.
Figure 12:
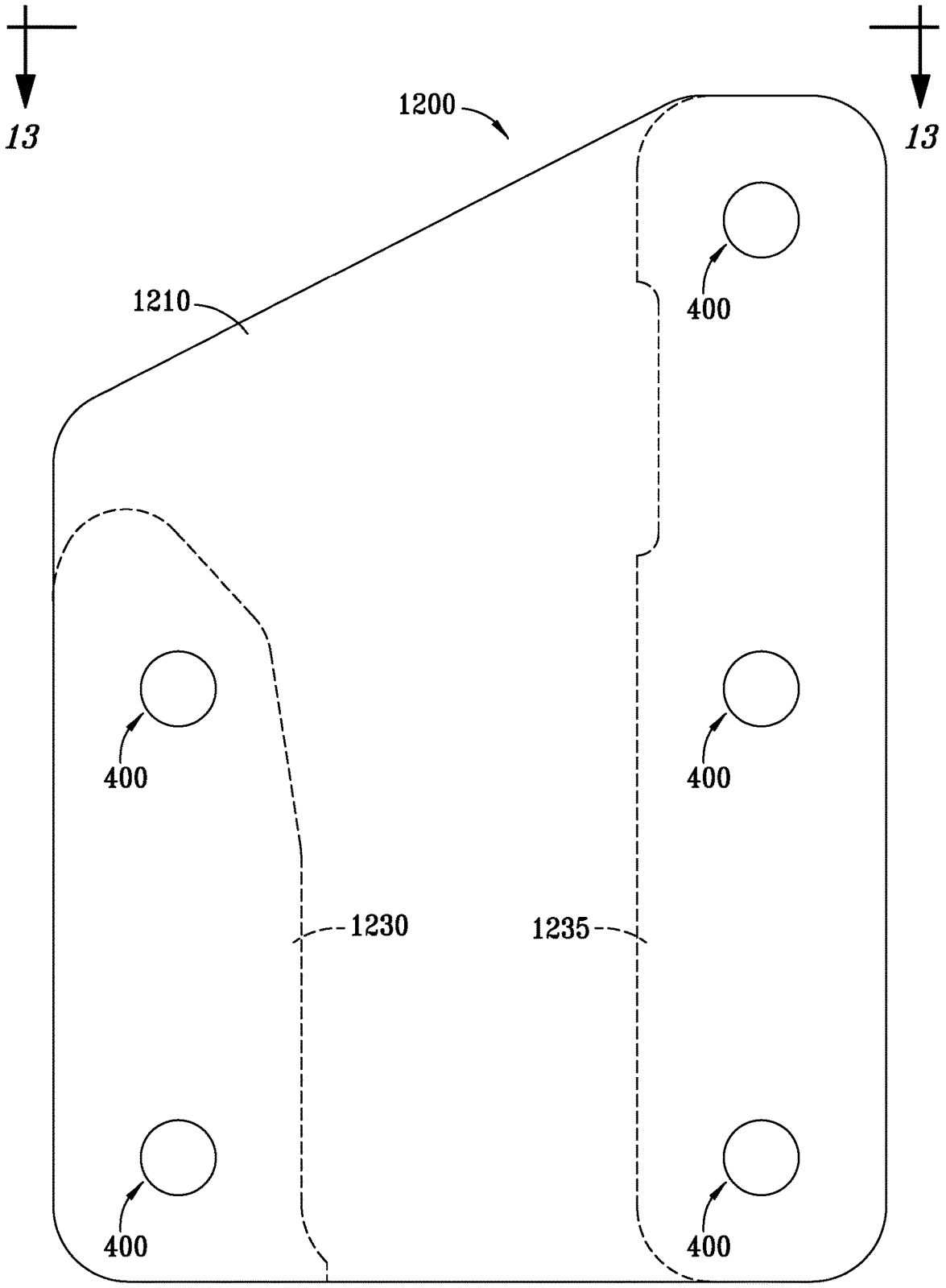
FIG. 12 is an front view of a holster assembly exemplified in accordance with a fourth embodiment of the present invention.
Figure 13:
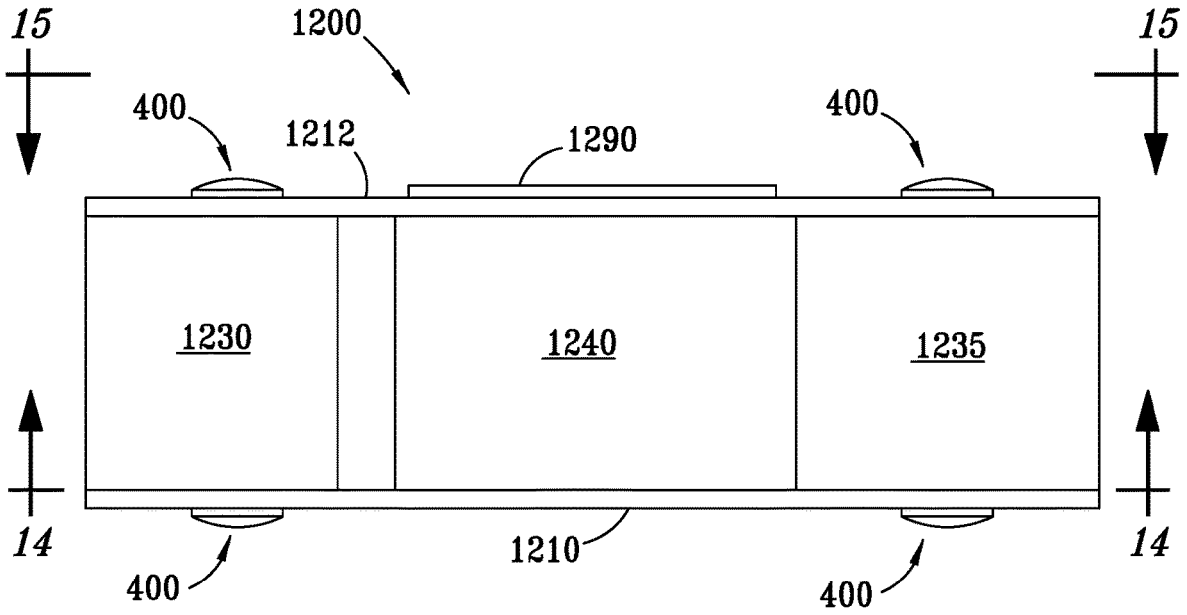
FIG. 13 is a top view of the holster assembly of FIG. 12 taken along view line 13-13 of FIG. 12.

Referring now to FIG. 11, holster assembly 800 has attachment means 890 secured to rear end wall 812. In one embodiment, attachment means 890 comprise magnetic strips, which are secured to rear wall 812 by an adhesive. In other embodiments, attachment means 890 comprise one or more hook-and-loop fastener strips (e.g. Velcro® strips). Attachment means 890 allows holster assembly 800 to be removably secured to a surface, such as the interior of a gun safe thereby freeing up valuable shelf space.

Figure 14:
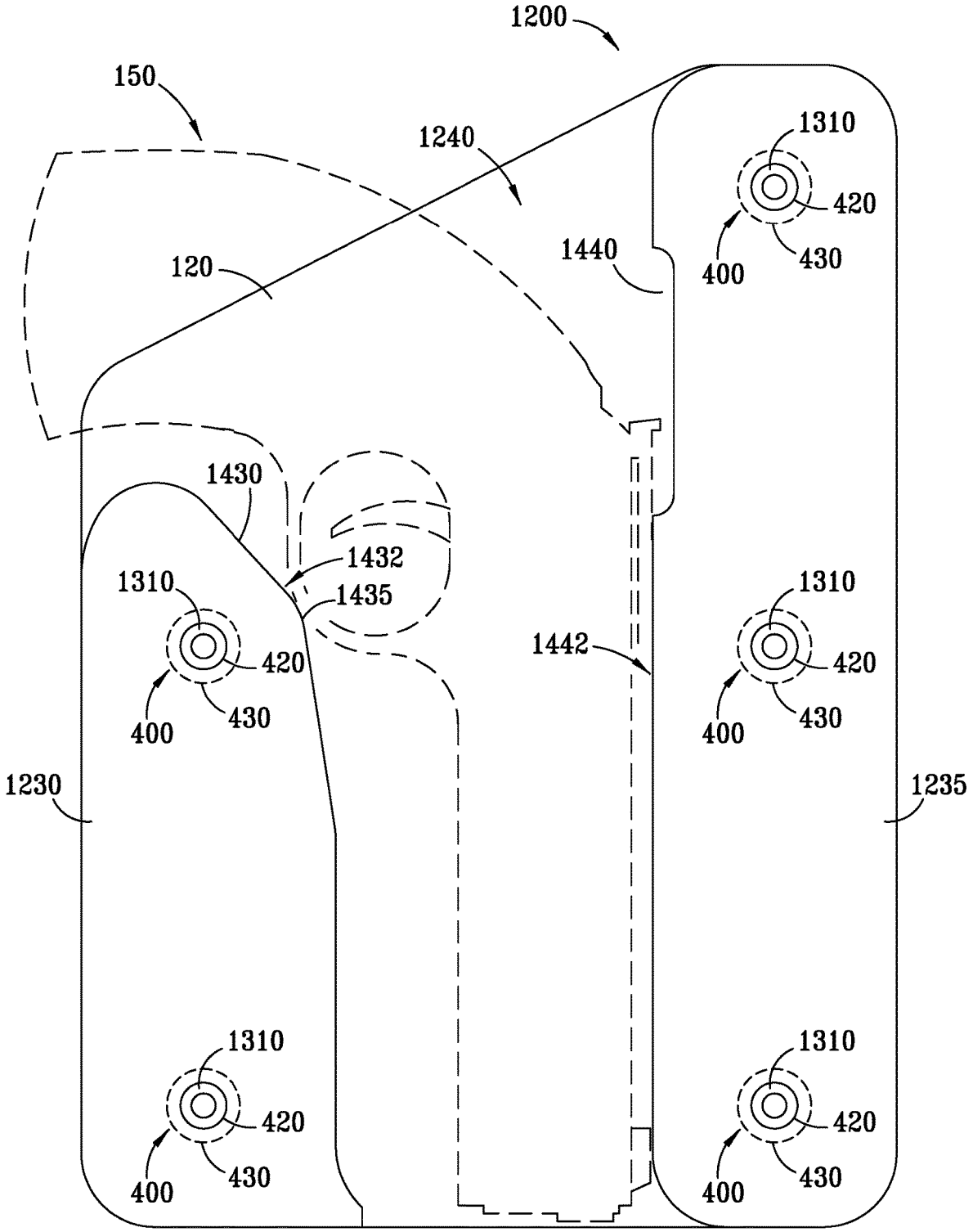
FIG. 14 is a cross-sectional view of the holster assembly of FIG. 12 taken along section line 14-14 of FIG. 13 exemplified holstering a handgun.

Referring to FIGS. 12-15, an alternative embodiment of the holster assembly, designated by reference numeral 1200, comprises front end wall 1210 and rear end wall 1212. Cradle 1240 is formed between front wall 1210, rear wall 1212, first supporting pad 1230, and second supporting pad 1235. Cradle 1240 is configured to holster, for example, handgun 150 (FIG. 14). First and second trigger-guard slopes 1430 and 1435 are formed along cradle-facing surface 1432 of first supporting pad 1230 and are configured for holstering handguns of differing sizes. Sight-slot 1440 is formed in barrel-support surface 1442 of second supporting pad 1235 and prevents the sights of handgun 150 from damaging second supporting pad 1235 when holstered.

Figure 15:
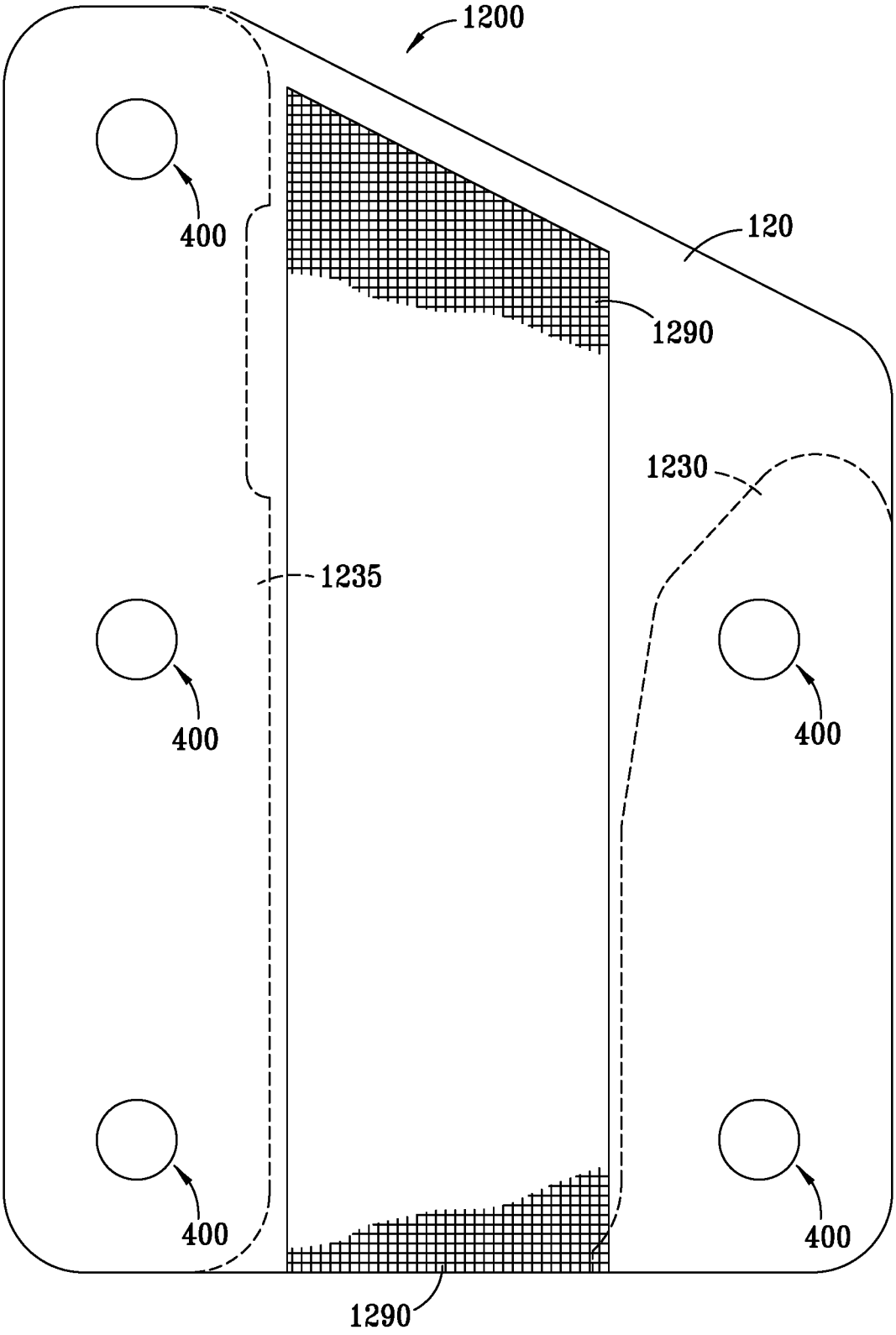
FIG. 15 is a rear view of the holster assembly of FIG. 12 taken along view line 15-15 of FIG. 13.

Holster assembly 1200 is secured using fasteners 400 (FIG. 4), comprising tubes 420 and plugs 430. Tubes 420 are inserted into each set of aligned openings 1310. The ends of each tube are secured by plugs 430. Holster assembly 1200 has attachment means 1290 secured to rear wall 1212. In one embodiment, attachment means 1290 comprises of a hook-and-loop fastener (e.g., a Velcro® strip), which are secured to rear wall 1212 by adhesive (FIG. 15). In other embodiments, attachment means 1290 may comprise multiple Velcro® strips or one or more magnetic strips.

Figure 16:
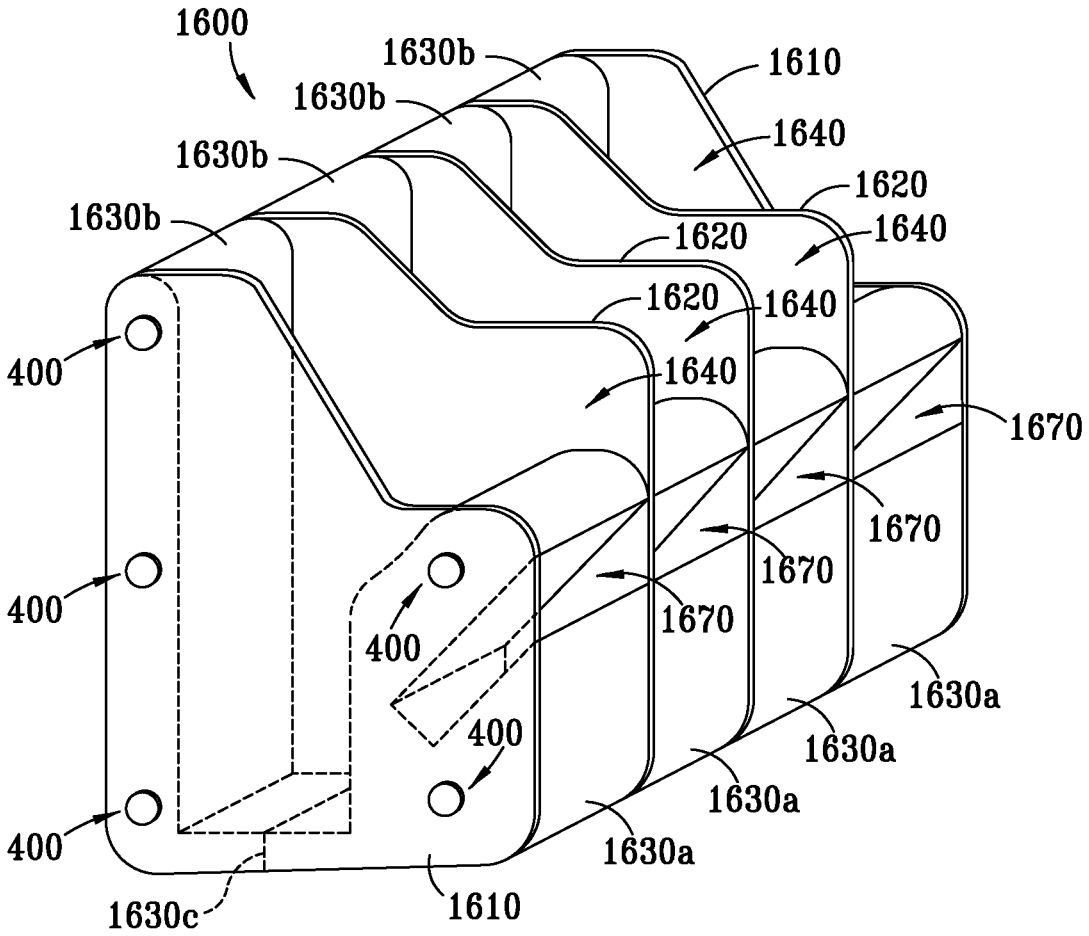
FIG. 16 is an isometric view of a holster assembly exemplified in accordance with a fifth embodiment of the present invention, exemplified oriented in a first position.
Figure 17:
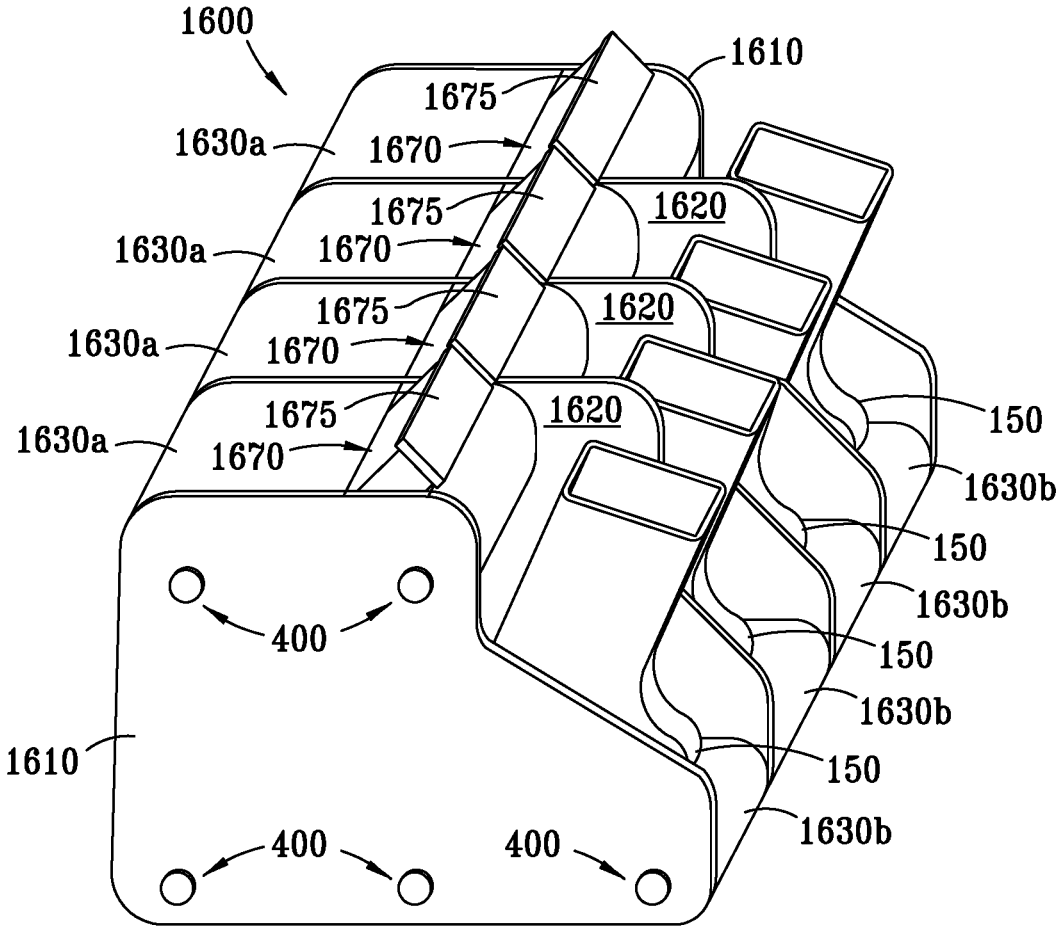
FIG. 17 is an isometric view of the holster assembly of FIG. 16, exemplified oriented in a second position and holstering four handguns and four magazines of ammunition.

Referring now to FIGS. 16-19, an alternative embodiment of the holster assembly, designated by reference numeral 1600, comprises end walls 1610. Dividing walls 1620 are secured between end walls 1610. Supporting pads **1630*a* and 1630*b* are located between adjacent walls as shown. FIGS. 16 and 17 exemplify four cradles 1640, which are defined between end walls 1610, dividing walls 1620, and supporting pads 1630, though more or fewer cradles 1640 may be so defined. Cradles 1640 are exemplified each holstering handgun 150 in FIG. 17**.

Figure 18:
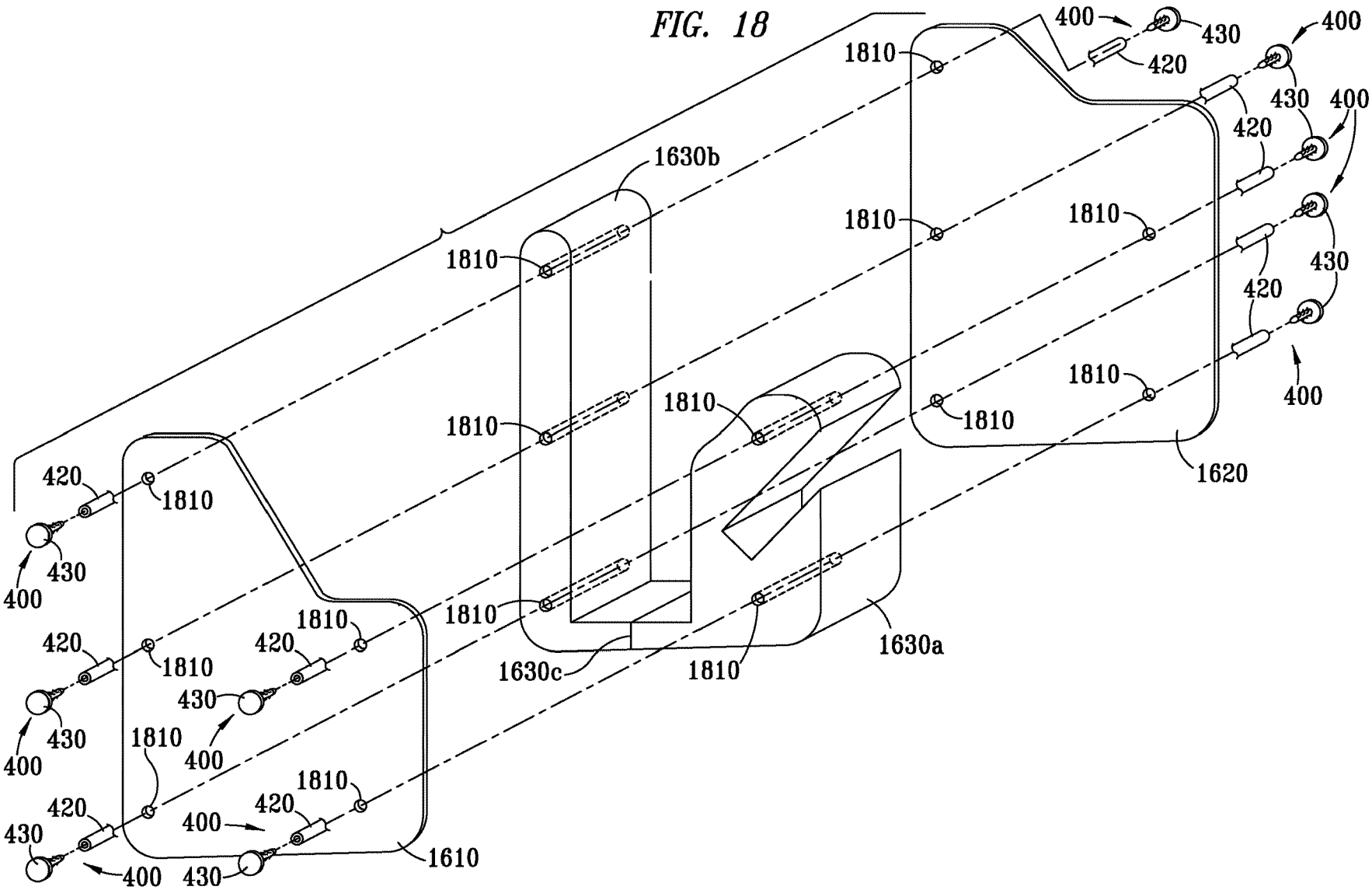
FIG. 18 is an exploded view of a portion of the holster assembly of FIG. 16.
Figure 19:
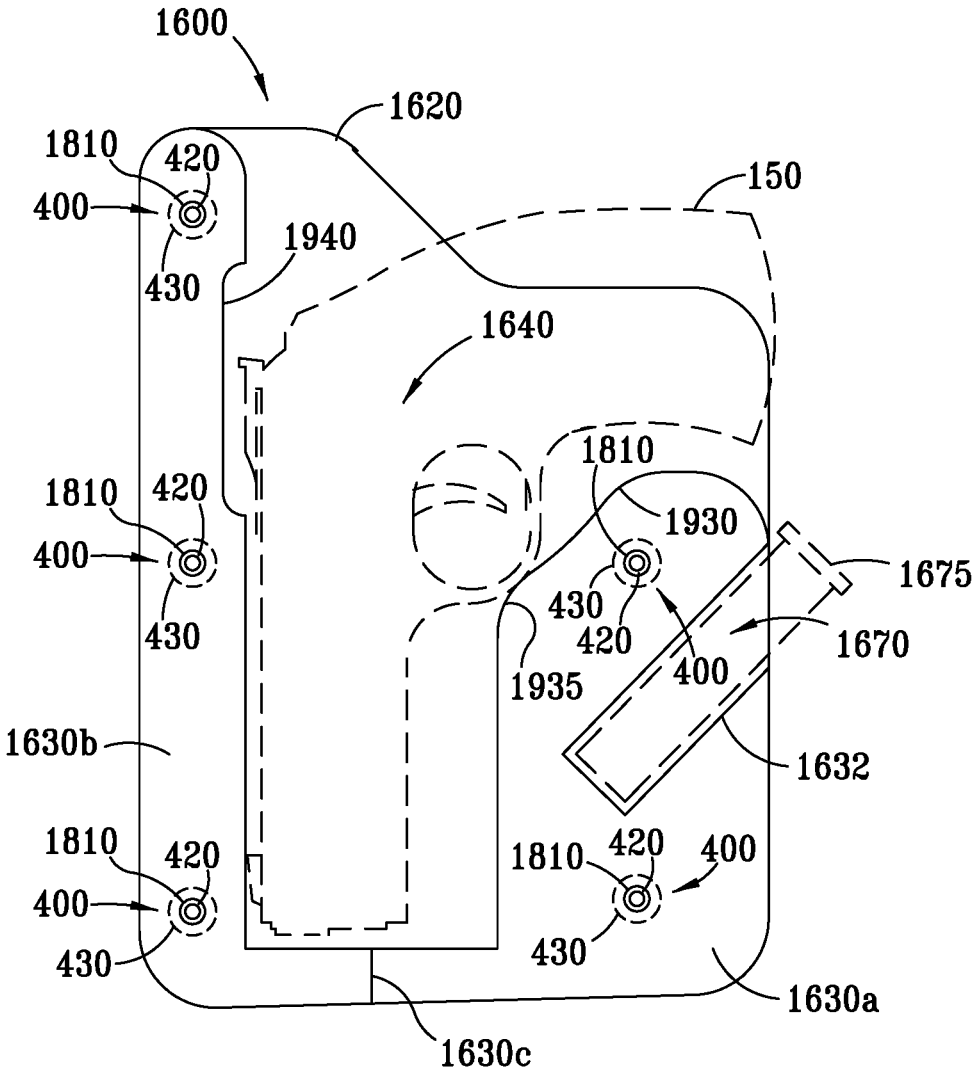
FIG. 19 is side view of the holster assembly of FIG. 16, taken having an end wall removed and exemplified holstering a handgun and storing a magazine of ammunition.

Recessed cavity 1632 is formed in each supporting pad **1630*a* and defines storage compartment 1670 along with the adjacent walls (see FIG. 18). Storage compartments 1670 can be used to store any item. In one embodiment, storage compartments 1670 are configured to store an ammunition magazine 710. In other embodiments, storage compartments 1670 are configured to store a flashlight. Storage compartments 1670 are exemplified in FIG. 17 as each storing a magazine of ammunition 1675**.

First and second trigger-guard slopes 1930 and 1935 are formed on the cradle-facing surface of each supporting pad **1630*a*. First trigger-guard slope 1930 allows for the holstering of larger handguns while second trigger-guard slope 1935 allows the holstering of smaller handguns. Sight-slot 1940 is formed in the barrel-support surface of each supporting pad 1630*b* to prevent the sights of a holstered handgun 150 from damaging supporting pad 1630*b***.

Holster assembly 1600 is secured using fasteners 400 (FIG. 4). Sets of aligned openings 1810 are formed in each end walls 1610, dividing walls 1620, supporting pads 1630 (FIG. 18). Tubes 420 extend through each array of aligned openings 1810. Plugs 430 secure the ends of tube 420.

Holster assembly 1600 may be oriented vertically as exemplified in FIG. 16, or it may be oriented horizontally as exemplified in FIG. 17. In an alternate embodiments, supporting pads **1630*a* and 1630*b* formed from a single unitary pad. However, less material is required when supporting pads 1630*a* and 1630*b* are individually patterned and cut. It is further advantageous for supporting pads 1630*a* and 1630*b* to be individually fabricated to come together at a junction 1630*c* as this permits the barrel of a handgun to protrude through the junction 1630*c*, thus allowing handguns of any barrel length to be holstered in holster assembly 1600**.

In the assembly of holster assemblies 100, 500, 800, 1200, and 1600 described above, the supporting pads are preferably fabricated from a suitable sheet of foam, such as a polyethylene foam. The sheet of foam preferably has a thickness (such as 1.5 inches) suitable for forming a cradle sized for receiving and holstering a selected handgun. The sheet of foam is then suitably cut, preferably using a water jet cutter, to form respective supporting pads. Thus, each supporting pad is preferably fabricated from a single, unitary piece of foam.

The end walls and the dividing walls are preferably cut from a sheet of tough plastic (e.g., acrylonitrile butadiene styrene, aka ABS) using a water jet cutter. The sheet of plastic preferably has a thickness, such as about 0.10 inches, sufficient to provide desired vertical and transverse structural support, yet flexible enough to bend when a lateral force is applied. This allows for handguns of different widths to be stored in cradles, including handguns whose widths exceed the width of a given cradle. For example, a revolver having a cylinder wider than the cradle can be accommodated as the walls can flex. As such, holster assembly has the benefit of accommodating virtually any sized handgun.

The walls and the supporting pads are preferably secured using fasteners such as tube-and-plug fasteners 400 (FIG. 4). Arrays of aligned openings are formed in each wall and each supporting pad. The openings are preferably formed using a water jet cutter. In a preferred embodiment, openings are preferably approximately 0.25 inches in diameter. A tube is extended through each set of aligned openings. After securing one end of each tube using a plug (or other means for securing the end), the walls and supporting pads of the holster assembly are urged into their proper position along the tube. The tubes are not pre-cut to precisely the needed length. Instead, the tubes are initially cut to a length slightly longer than the anticipated width of a finished holster assembly. As such, the unplugged end of each tube protrudes out from the adjacent end wall. The excess portion of each tube is then removed using a tool, e.g., a razor blade. Plugs are then inserted into the unplugged end of each tube. When the body of a plug is inserted into the end of a tube, the end of the tube is enlarged. This enlargement causes the tube to urge against the opening in the end wall, which provides additional friction to secure the holster assembly together. Furthermore, because the length of the tube is precisely the width of a particular holster assembly, the head of the cap urges against the exterior surface of the end wall providing additional structural stability.

The method of securing the holster assemblies in accordance with principles of the invention provides a number of advantages not seen in the prior art. For example, it is particularly useful because the width of each component (e.g., the foam supporting pads) may vary by as much as ⅛ of an inch, which causes the finished width of the entire holster assembly to vary. If the tubes were precisely cut, some tubes would be too long or too short. Cutting the tubes after inserting them into the holster assembly ensures that each tube will be precisely the correct length for that particular holster assembly. This allows components (e.g., the foam supporting pads) to be cut using less expensive and less precise techniques, thus reducing manufacturing costs.

The use of plastics and foam provides further advantages of a strong, yet lightweight, holster assembly. In particular, lightweight foam is preferably used for larger components, such as the supporting pads. Stronger plastic is used for the walls and fasteners, which provide rigidity in all three dimensions and prevents the foam supporting pads from being crushed. Moreover, in a preferred embodiment, the present invention does not require any metal components, which are not only more costly but can also scratch or damage a handgun. Still further, the holster assemblies also avoid the use of adhesives, which can deteriorate over time and potentially damage a handgun.

It is understood that the present invention may take many forms and embodiments. Accordingly, several variations may be made in the foregoing without departing from the spirit or the scope of the invention. For example, the holster assemblies can be easily modified to holster additional handguns by defining additional cradles by adding additional walls and supporting pads.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of the preferred embodiments. Accordingly, it is appropriate that the appended claims be construed broadly and in a manner consistent with the scope of the invention.

The invention claimed is:

1. An apparatus for securely storing a handgun, the apparatus comprising:

a first end wall and a second end wall;

a first supporting pad secured between the first end wall and the second end wall, the first supporting pad defining a cradle-facing surface configured to pad an upper surface of a barrel of a handgun;

a second supporting pad secured between the first end wall and the second end wall, the second supporting pad defining a trigger-guard slope configured to urge against a trigger guard of a handgun being holstered in the cradle, wherein the first supporting pad and the second supporting pad are configured to come together at a junction proximate a muzzle of a handgun to wrap around and pad the muzzle end of a handgun;

at least one hollow tube extending through an array of aligned openings formed in the first end wall, the second end wall, and the first and second supporting pads; and at least one pair of plugs, each plug having a body inserted into an end of the at least one hollow tube and a head urged against an exterior surface of the first end wall and the second end wall, respectively.

2. The apparatus of claim 1 further comprising:

at least one dividing wall secured between the first end wall and the second end wall;

at least one additional supporting pad;

the at least one additional supporting pad and the at least one dividing wall defining at least one additional cradle configured for holstering a handgun; and the tube extending through an array of aligned openings formed in the at least one dividing wall and the at least one additional supporting pad.

3. The apparatus of claim 1, wherein the supporting pad is configured to define:

a barrel-support surface configured to support a bottom surface of a barrel of a handgun;

a grip-support surface configured to support a bottom surface of a grip of a handgun; and a flange configured to secure a heel of a handgun.

4. The apparatus of claim 1, wherein:

the second supporting pad defines a second trigger-guard slope configured to urge against a trigger guard of a second handgun of a second size being holstered in the cradle.

5. The apparatus of claim 1, wherein:

a sight-slot is formed in the cradle-facing surface configured to prevent a sight of a handgun from damaging the first supporting pad.

6. The apparatus of claim 1, wherein ribbing is configured to enable the plugs to be readily inserted into an end of the tube, but to resist removal from the end of the tube.

7. The apparatus of claim 1 further comprising:

a first auxiliary pad and a second auxiliary pad secured between the first end wall and the second end wall;

wherein the first auxiliary pad is secured above the second auxiliary pad; and wherein the first auxiliary pad, the second auxiliary pad, the first end wall, and the second end wall define a storage compartment.

8. The apparatus of claim 1 further comprising:

a first auxiliary pad and a second auxiliary pad secured between the first end wall and the second end wall;

wherein the first auxiliary pad is secured above the second auxiliary pad; and wherein the first auxiliary pad, the second auxiliary pad, the first end wall, and the second end wall define a storage compartment adapted for storing a magazine of ammunition.

9. The apparatus of claim 1 further comprising:

a first auxiliary pad and a second auxiliary pad located between the first end wall and the second end wall;

wherein the first auxiliary pad is secured above of the second auxiliary pad; and wherein the first auxiliary pad, the second auxiliary pad, the first end wall, and the second end wall define a storage compartment adapted for storing a flashlight.

10. The apparatus of claim 1, wherein:

the second supporting pad defines a recessed cavity; and the recessed cavity, the first end wall, and the second end wall define a storage compartment.

11. The apparatus of claim 1, wherein the tube is a hollow, cylindrical plastic tube.

12. The apparatus of claim 1, wherein the tube is a hollow, cylindrical plastic tube having a diameter between ⅛ inch and ¼ inch.

13. The apparatus of claim 1 further comprising attachment means for attaching and detaching the apparatus to and from a surface.

14. The apparatus of claim 1 further comprising a hook-and-loop fastener secured to one of either the first end wall or the second end wall, wherein the hook-and-loop fastener is configured for attaching and detaching the apparatus to and from a surface having a complementary hook-and-loop fastener.

15. The apparatus of claim 1 further comprising a magnetic strip secured to one of either the first end wall or the second end wall, wherein the magnetic strip is configured for attaching and detaching the apparatus to and from a metal surface.

16. The apparatus of claim 1, wherein the supporting pad is fabricated from polyethylene foam.

17. The apparatus of claim 1, wherein the first end wall and the second end wall are fabricated from of acrylonitrile butadiene styrene (ABS).

18. The apparatus of claim 1 further comprising an angled seat formed in the first end wall, the second end wall, and the supporting pad.

19. The apparatus of claim 1 wherein each plug comprises a respective head and a respective cylindrical body, and each cylindrical body includes ribbing extending perpendicular to the longitudinal axis of the plug.

20. The apparatus of claim 1 wherein each plug comprises a respective head and a respective cylindrical body, and each cylindrical body includes discontinuous ribbing extending perpendicular to the longitudinal axis of the plug.

21. A kit having component parts capable of being assembled into a holster, the kit comprising:

a first end wall and a second end wall;

a first supporting pad capable of being removably secured between the first end wall and the second end wall to thereby define a cradle for holstering a handgun, the first supporting pad being configured to pad an upper surface of a barrel of a handgun;

a second supporting pad secured between the first end wall and the second end wall, the second supporting pad defining a trigger-guard slope configured to urge against a trigger guard of a handgun being holstered in the cradle, wherein the first supporting pad and the second supporting pad are configured to come together at a junction proximate a muzzle of a handgun to wrap around and pad the muzzle end of a handgun;

at least one hollow tube capable of being removably extended through an array of aligned openings formed in the first end wall, the second end wall, and the supporting pad; and at least one pair of plugs, each plug having a body capable of being removably inserted into a respective end of the at least one hollow tube, and each plug further having a head capable of being urged against an exterior surface of one of either the first end wall or the second end wall, respectively, when assembled.

* * * * *